United States Patent [19]

Ambrose

[11] 4,372,059

[45] Feb. 8, 1983

[54] SOLE BODY FOR SHOES WITH UPWARDLY DEFORMABLE ARCH-SUPPORTING SEGMENT

[76] Inventor: Frank Ambrose, 5805 Washington St., Apt. #17, Hollywood, Fla. 33023

[21] Appl. No.: 240,484

[22] Filed: Mar. 4, 1981

[51] Int. Cl.[3] ..... A43B 13/04; A43B 13/18

[52] U.S. Cl. ..... 36/32 R; 36/30 R; 36/103

[58] Field of Search ..... 36/32 R, 30 R, 31, 83, 36/103, 104, 114, 129

[56] References Cited

U.S. PATENT DOCUMENTS

| | | | |
|---|---|---|---|
| 2,374,487 | 4/1945 | Jayne | 36/32 R |
| 2,435,976 | 2/1948 | Monagin | 36/30 R |
| 4,030,213 | 6/1977 | Daswick | 36/32 R |
| 4,133,118 | 1/1979 | Khalsa et al. | 36/83 |
| 4,155,180 | 5/1979 | Phillips | 36/103 X |
| 4,241,523 | 12/1980 | Daswick | 36/30 R |
| 4,262,433 | 4/1981 | Hagg et al. | 36/32 R |

FOREIGN PATENT DOCUMENTS

| | | | |
|---|---|---|---|
| 2729450 | 1/1979 | Fed. Rep. of Germany | 36/129 |
| 1490219 | 10/1977 | United Kingdom | 36/32 R |

*Primary Examiner*—James Kee Chi

*Attorney, Agent, or Firm*—Oltman and Flynn

[57] ABSTRACT

This shoe sole has a resiliently deformable, arch-supporting middle segment extending between a heel-supporting rear segment and a toe-supporting front segment. The middle segment has an upwardly projecting, longitudinally convex, top face and a downwardly projecting, longitudinally convex, bottom face which, when flattened by the wearer's weight, pushes the top face up against the wearer's arch.

6 Claims, 7 Drawing Figures

FIG. 1
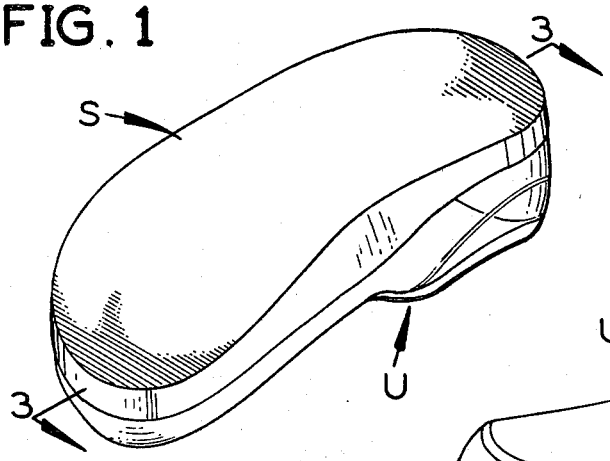
FIG. 2
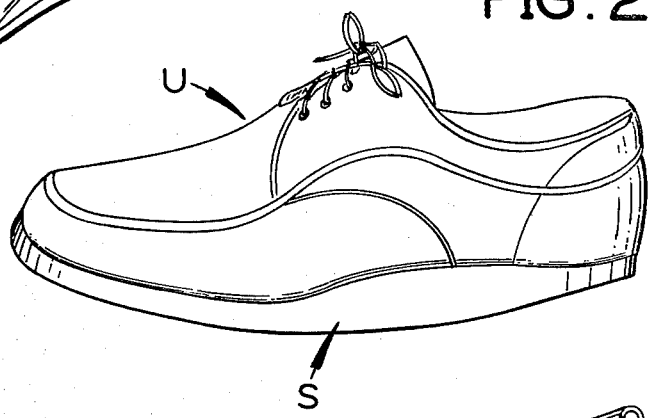
FIG. 3
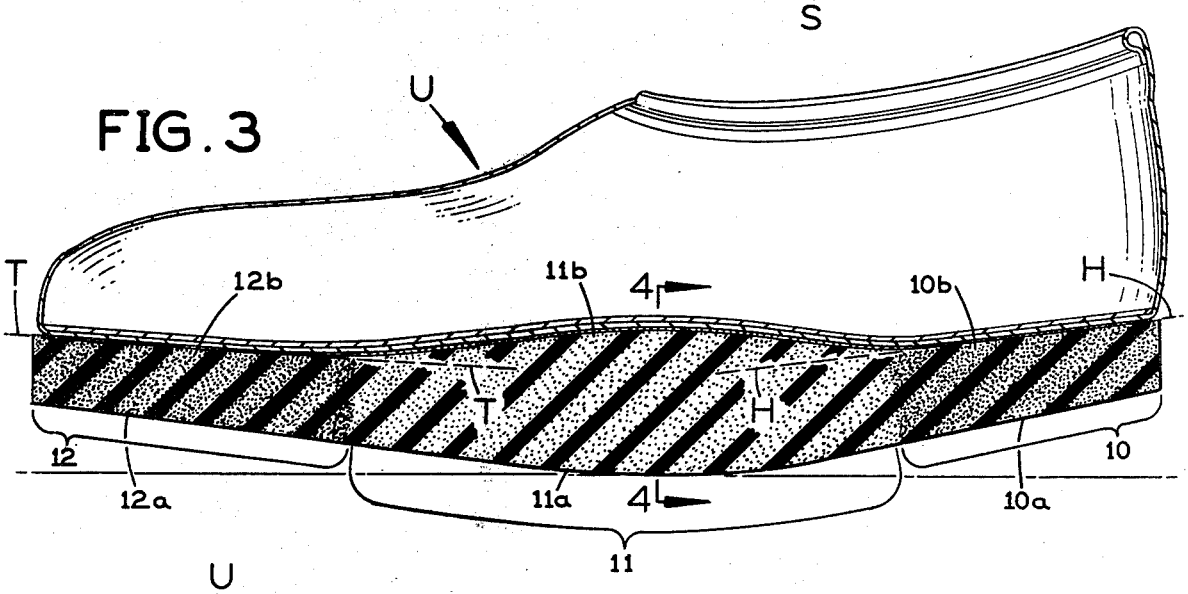
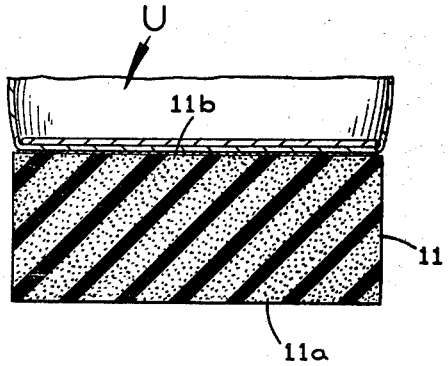
FIG. 4

SOLE BODY FOR SHOES WITH UPWARDLY DEFORMABLE ARCH-SUPPORTING SEGMENT

SUMMARY OF THE INVENTION

This invention relates to a shoe sole.

A principal object of this invention is to provide a shoe sole which does not have the usual steel shank between the heel and sole but instead has a resiliently deformable middle segment of novel configuration which provides resilient, cushioned support for the arch of the wearer's foot and distributes the wearer's weight on the feet while standing, walking or running in such a manner as to promote his or her comfort and health.

In the presently preferred embodiment, the shoe sole in accordance with this invention has a heel-supporting rear segment, a toe-supporting front segment and an arch-supporting middle segment. The middle segment has a longitudinally convex bottom face and a longitudinally convex top face which projects up beyond the plane of the top face of the heel-supporting rear segment of the sole and projects up beyond the plane of the top face of the toe-supporting front segment of the sole. The arch-supporting middle segment of the sole is resiliently deformable so that it pushes up against the arch of the wearer's foot when its normally convex bottom face is flattened while the wearer is standing still, and also during each step while walking or running until the foot is pivoted forward to put most of the wearer's weight on the toes and the ball of that foot. Preferably, the entire shoe sole is a one-piece molded body of resiliently deformable material which is more readily deformable in the arch-supporting middle segment than in the heel-supporting rear segment and the toe-supporting front segment.

Further objects and advantages of the invention will be apparent from the following detailed description of the presently preferred embodiment shown in the accompanying drawings.

DESCRIPTION OF THE DRAWINGS

FIG. 1 is a bottom perspective view of a shoe having the present sole;

FIG. 2 is a side elevation of this shoe;

FIG. 3 is an enlarged vertical longitudinal section through the shoe, taken along the line 3—3 in FIG. 1;

FIG. 4 is a vertical cross-section taken along the line 4—4 in FIG. 3 midway along the arch-supporting middle segment of the shoe sole;

Figure 5:
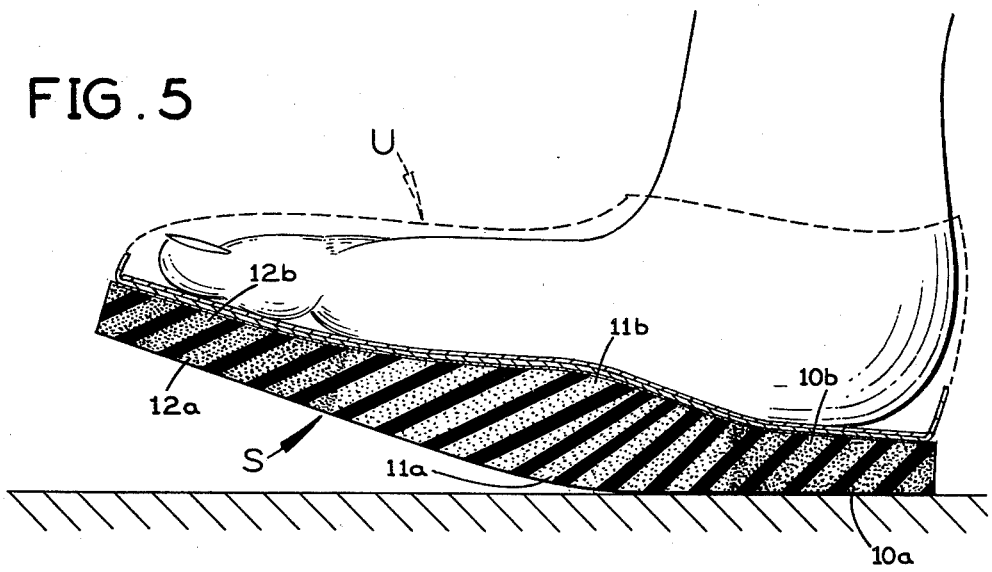
FIG. 5 is a view similar to FIG. 3 showing the position of the sole when the wearer's weight is on the heel of the foot during a step while walking or running.

Before explaining the disclosed embodiment of the present invention in detail, it is to be understood that the invention is not limited to the details of the disclosed arrangement.

DETAILED DESCRIPTION

Referring to FIG. 2, the shoe sole S of the present invention is shown permanently attached to the bottom of a shoe upper U of any suitable design and any suitable material, such as leather, synthetic plastic, or natural or synthetic fabric. The present sole may be cemented to the midsole of a welted shoe having a midsole, or it may be cemented directly to the welt on a welted shoe which does not have a midsole, or it may be cemented to an unwelted sport shoe having an insole and an upper.

Referring to FIG. 3, the sole consists of a heel-supporting rear segment 10, an arch-supporting middle segment 11 joined integrally to the rear segment and extending forward from it, and a toe-supporting front segment 12 joined integrally to the middle segment 11 and extending forward from it.

The rear segment 10 of the sole has a very slight longitudinal taper from front to back which makes it slightly thicker vertically where it is joined to the middle segment 11 than at its back edge. It presents a substantially flat bottom face **10*a* and a substantially flat top face 10*b* which lies in a plane designated by the dashed line H in FIG. 3**.

The front segment 12 of the sole has a very slight longitudinal taper from back to front so that it is slightly thicker vertically where it is joined to the middle segment 11 than at its front edge. It presents a substantially flat bottom face **12*a* and a substantially flat top face 12*b* which lies in a plane designated by the dashed line T in FIG. 3. In the normal, unstressed condition of the shoe when it is not being worn, the plant T of the top face 12*b* of the front segment 12 of the shoe sole extends at an angle of slightly less than 180 degrees to the plane H of the top face 10*b* of the rear segment 10** of the shoe sole.

The middle segment 11 of the shoe sole has a convex bottom face **11*a* which merges smoothly with the bottom face 10*a* of the rear segment 10 and merges smoothly with the bottom face 12*a* of the front segment 12 of the shoe sole. From FIG. 3 it will be evident that the convex bottom face 11*a* of the middle segment extends down below the bottom faces 10*a* and 12*a* of the rear and front segments and the apex of its curvature (i.e., the low point) is located at the section line 4—4**.

The middle segment of the shoe sole also has a convex top face **11*b* which merges smoothly with the top face 10*b* of the rear segment and merges smoothly with the top face 12*b* of the front segment. As shown in FIG. 3, the apex of curvature (i.e., the high point) of the convex top face 11*b* is located substantially at the section line 4—4, so that it is substantially aligned vertically with the low point of the bottom face 11*a*. Consequently, the middle segment 11 has its maximum vertical thickness at the section line 4—4** about midway along the length of the middle segment and directly under the arch of the wearer's foot, preferably at the location of the Navicular.

Preferably, the entire sole S is a one-piece, integral, molded body of relatively soft, deformable and resilient material having rubber-like characteristics. The density is substantially smaller in the middle segment 11 than in either the rear segment 10 or the front segment 12 so that it is softer and much more readily deformable in the middle segment.

As shown in FIG. 4, in this particular embodiment of the invention at the arch-supporting middle section 11 the sole is of uniform vertical thickness across its entire width. This is also true for any vertical cross-section through the shoe sole anywhere else along its length in this embodiment of the invention.

If desired, the shoe sole may be formed with laterally elongated, readily flexible, serrations or lips on the bottom in close succession along its length.

Figure 6:
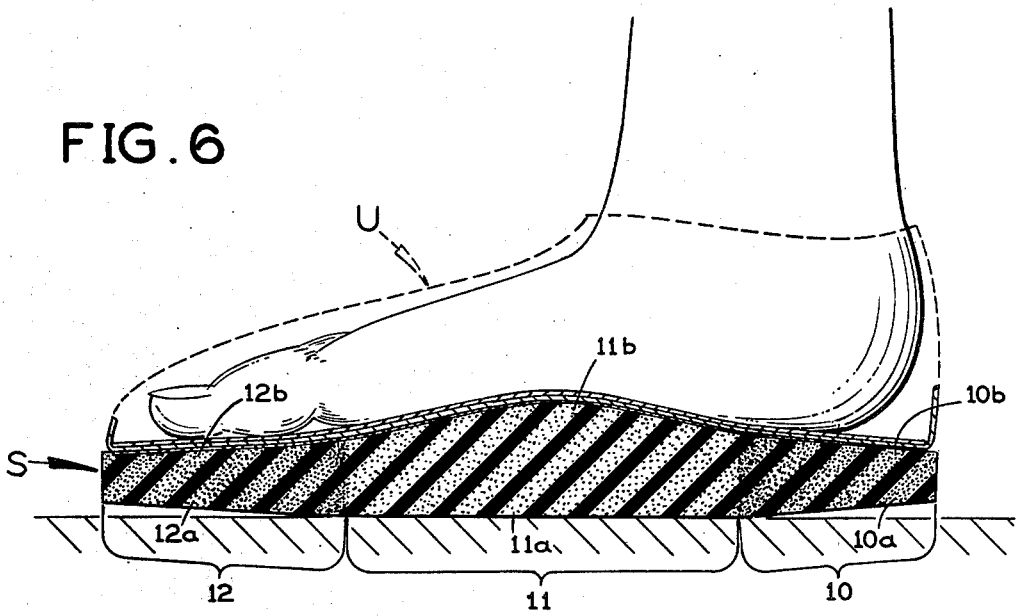
FIG. 6 is a view similar to FIG. 5 and showing the position of the sole when the wearer is standing still or during walking or running is in the process of shifting his or her weight forward from the heel onto the ball and toes of the foot.

As shown in FIG. 6, when the wearer is standing still, his or her weight tends to flatten the bottom of the shoe sole from the much more convex, normal, unstressed shape shown in FIG. 3. The normally convex bottom face 11*a* of the middle segment is flattened and it carries virtually all of the wearer's weight. The material of the middle segment 11 is deformed upwardly into snug engagement with the bottom of the foot throughout the entire length of the arch. Most of the wearer's weight is distributed along the length and width of the arch and relatively little is on the heel or the toes.

Figure 7:
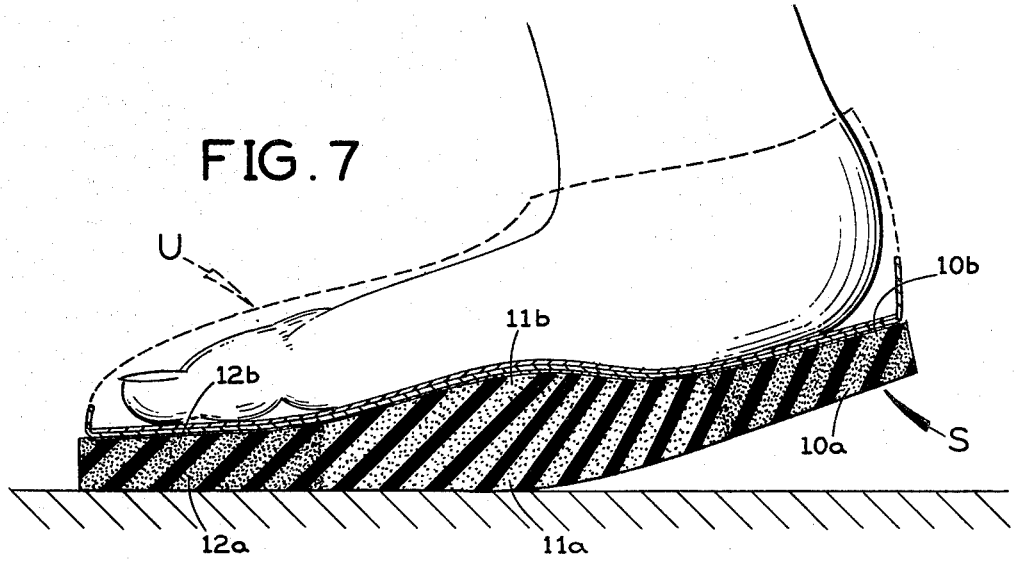
FIG. 7 is a view similar to FIGS. 5 and 6 and showing the position of the sole when the wearer's weight has been shifted forward onto the ball and toes of the foot while walking or running, with continuous metatarsal support.

When the user takes a forward step, normally the foot will move through the successive positions shown in FIGS. 5, 6 and 7. First, he or she comes down on the heel (FIG. 5), and the ball of the foot and toes are raised. In this first part of the step the rear segment 10 and the rear half of the middle segment 11 of the shoe sole are flattened as shown in FIG. 5. This partial flattening of the middle segment causes some upward deformation of the sole into more snug engagement with the arch of the foot.

Part-way through the step, the wearer's foot and the shoe sole will assume the position shown in FIG. 6 in which, as already described, the arch is fully supported by the upwardly deformed middle segment 11 of the shoe sole to effectively cushion the shock of the step.

Later on in the step, the foot will be pivoted to the position shown in FIG. 7 in which the reverse of the process shown in FIG. 5 takes place. In this position of the shoe sole, part of its middle segment 11 is deformed upwardly to provide continued support for the arch of the foot.

During walking or running, the longitudinally convex curvature of the bottom of the shoe sole not only makes it easier for the person to move forward but by flattening out as described it also insures the upward deformation of the middle segment 11 of the shoe sole under the arch to provide resilient support for the foot where it is most needed. In so deforming, the middle segment 11 of the sole can conform to a variety of shapes of the foot arch, which varies from one person to the next.

I claim:

1. In a shankless sole body for shoes having:

a heel-supporting rear segment with a top face and a bottom face;

an arch-supporting middle segment of deformable resilient material extending forward from said rear segment and having a top face and a bottom face merging smoothly with said top and bottom faces of said rear segment;

and a toe-supporting front segment extending forward from said middle segment and having a top face and a bottom face merging smoothly with the top and bottom faces of said middle segment;

the improvement wherein:

said top face of the middle segment is convex longitudinally of the sole across substantially its complete width and projects above the respective planes of the top face of said rear segment and the top face of said front segment, said bottom face of said middle segment is convex longitudinally of the sole across substantially its complete width and projects below the bottom faces of said rear and front segments, said middle segment at any point thereon longitudinally of the sole has a substantially uniform vertical thickness across its complete width, and said middle segment is resiliently deformable under the wearer's weight to flatten its bottom face and push its top face up against the arch of the wearer's foot to redistribute the wearer's weight onto the arch.

2. A sole body according to claim 1, wherein the high point of said convex top face of said middle segment is substantially aligned vertically with the low point of said convex bottom face of said middle segment.

3. A sole body according to claim 1, wherein the high point of said convex top face of said middle segment is located substantially directly beneath the Navicular of the wearer's foot.

4. A sole body according to claim 3, wherein the low point of said convex bottom face of said middle segment is located substantially directly beneath the high point of said convex top face of said middle segment.

5. A sole body according to claim 4, wherein said rear and front segments are also of said deformable resilient material, and said middle segment is more easily deformable than both said rear and front segments.

6. A sole body according to claim 1, wherein said rear and front segments are also of said deformable resilient material, and said middle segment is more easily deformable than both said rear and front segments.

* * * * *